US011998128B2

(12) United States Patent
Miller

(10) Patent No.: US 11,998,128 B2
(45) Date of Patent: Jun. 4, 2024

(54) OPENABLE AND CLOSABLE NAPKIN SLEEVE

(71) Applicant: Velma E Miller, Mitchellville, MD (US)

(72) Inventor: Velma E Miller, Mitchellville, MD (US)

( * ) Notice: Subject to any disclaimer, the term of this patent is extended or adjusted under 35 U.S.C. 154(b) by 114 days.

(21) Appl. No.: 17/943,334

(22) Filed: Sep. 13, 2022

(65) Prior Publication Data

US 2024/0081566 A1 Mar. 14, 2024

(51) Int. Cl.
*A47G 21/16* (2006.01)

(52) U.S. Cl.
CPC ..... *A47G 21/16* (2013.01)

(58) Field of Classification Search
CPC ..... A47G 21/16
USPC ..... 206/308.1, 15, 307; 383/66
See application file for complete search history.

(56) References Cited

U.S. PATENT DOCUMENTS

| | | | | | |
|---|---|---|---|---|---|
| 3,965,591 | A * | 6/1976 | Le Sueur | A47G 21/16 | 428/900 |
| D255,083 | S * | 5/1980 | Kott | 24/8 | |
| 4,494,718 | A * | 1/1985 | Clay | A47G 21/16 | 428/542.2 |
| 5,487,924 | A * | 1/1996 | Fritze | D04D 7/10 | 428/5 |
| 6,068,401 | A * | 5/2000 | Ho | A45C 3/001 | 150/900 |
| 6,186,662 | B1 * | 2/2001 | Jackson | A45C 3/00 | 383/117 |
| 6,550,635 | B1 * | 4/2003 | King | A47K 10/42 | 221/33 |
| D740,565 | S * | 10/2015 | Ludeman | D3/307 | |

* cited by examiner

*Primary Examiner* — Robert Sandy
(74) *Attorney, Agent, or Firm* — Stanzione & Associates, PLLC; Patrick Stanzione

(57) ABSTRACT

A flexible napkin sleeve formed into an elongated hollow enclosed cylinder and including an opening and closing means disposed along a substantial length of the napkin sleeve to open a significant length the napkin sleeve to insert a napkin therein and to close the napkin sleeve to retain the napkin therein.

14 Claims, 4 Drawing Sheets

OPENABLE AND CLOSABLE NAPKIN SLEEVE

STATEMENT REGARDING FEDERALLY SPONSORED RESEARCH OR DEVELOPMENT

Not applicable.

COPYRIGHT NOTICE

A portion of this disclosure contains material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever. 37 C.F.R 1.71(d).

BACKGROUND OF THE INVENTIVE CONCEPT

1. Field of the Invention

The present inventive concept relates to an enclosed elongated fabric napkin sleeve configured to be openable and closable to receive and secure a cloth napkin therein. More particularly, but not exclusively, this inventive concept relates to an enclosed elongated fabric napkin sleeve configured to be openable and closable to receive and secure a cloth napkin and utensils therein.

Description of the Related Art

Conventionally several types of napkin holders have been provided to secure a napkin therein for placement and aesthetic appearance of a napkin on a dining table.

U.S. Pat. No. DES 255,083 by Kott discloses a napkin ring design that is in the shape of a ring for receiving a napkin therein. This design is a simple ring intended to slide over a napkin.

U.S. Pat. No. 4,494,718 by Clay discloses a napkin holder formed of a mass of solid material including two intersecting holes formed through the solid material. Here a cloth napkin can be inserted through either one of the holes to create attractive configurations. This napkin holder is heavy, non-flexible and does not open or close to easily receive napkins therein.

U.S. Pat. No. 5,487,924 by Fritze discloses a napkin ring formed as an elongate strip and can be folded onto itself so that a napkin can be retained therein. This ring includes slots 51 and 61 which can be engaged with each other to form the ring. Here the ring is easily releasable to access and use the napkin.

U.S. Pat. No. 3,965,591 by Le Sueur discloses a napkin ring in the form of a solid cylinder. A magnet is formed into a recess in the solid cylinder for attachment of a name or initials within the recess.

Thus, there is a need for a napkin sleeve that covers a large portion of a cloth napkin while being able to open and close the sleeve for ease of placing the napkin therein and securing the napkin therein.

There is also a need for a napkin sleeve that covers a large portion of a cloth napkin as well as utensils while being able to open and close the sleeve for ease of placing the napkin and utensils therein and securing the napkin and utensils therein.

SUMMARY OF THE INVENTIVE CONCEPT

The present general inventive concept provides to an enclosed elongated fabric napkin sleeve configured to be openable and closable to receive and secure a cloth napkin therein. More particularly, but not exclusively, this inventive concept relates to an enclosed elongated fabric napkin sleeve configured to be openable and closable to receive and secure a cloth napkin and utensils therein.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a flexible napkin sleeve, comprising: a hollow enclosed elongated fabric material including an outer fabric and an inner fabric, the outer and inner fabrics being sewn together along four corresponding sides thereof to form a double thick fabric material, the hollow enclosed elongated fabric material having a slit formed lengthwise and originating at a top portion thereof and extending toward a bottom portion thereof such that the slit extends approximately ¾ the length of the hollow enclosed elongated fabric material; and an opening and closing means attached along opposite edges of the slit and being configured to open and close the slit.

In an exemplary embodiment, the opening and closing means is a zipper.

In another exemplary embodiment, the flexible napkin sleeve may further comprise an upper fabric ring formed circumferentially around an upper portion of the hollow enclosed elongated fabric material approximately one inch from the top portion thereof; and a lower fabric ring formed circumferentially around the bottom portion of the hollow enclosed elongated fabric material.

In another exemplary embodiment, the fabric is made of any one of cotton, silk, wool or leather.

In another exemplary embodiment, the shape of the hollow enclosed elongated fabric material is cylindrical.

In still another exemplary embodiment, the shape of the hollow enclosed elongated fabric material is rectangular or square.

The foregoing and/or other features and utilities of the present general inventive concept may also be achieved by providing a cylindrical napkin sleeve formed of a fabric comprised of one of cotton, wool, silk or leather material, comprising: a slit starting at a top portion of the sleeve and extending along ¾ of a length thereof toward a bottom portion of the sleeve; and a zipper disposed along the slit to open the slit to insert a napkin therein and to close the slit to retain the inserted napkin therein.

In an exemplary embodiment, the cylindrical napkin sleeve may further comprise a first fabric ring formed circumferentially around the sleeve adjacent to the top portion thereof; and a second fabric ring formed circumferentially around the sleeve along the bottom portion thereof.

In another exemplary embodiment, the napkin sleeve includes an outer material and an inner material, wherein the outer material and the inner material are sewn together to form a double wall material.

The foregoing and/or other features and utilities of the present general inventive concept may also be achieved by providing a method of making a flexible napkin sleeve, comprising: sewing edges of a first fabric material to edges of a second fabric material to form a single double walled fabric material having a width and a length; sewing a portion of opposite sides of the double walled cloth material to form a hollow enclosed elongated fabric having a slit along the length thereof which extends from a top portion thereof to approximately ¾ the length of the hollow enclosed elongated fabric and terminates at the sewn opposite sides; and attaching an opening and closing means along the edges of the slit to open and close the slit.

In an exemplary embodiment, the shape of the double walled fabric material is formed to be cylindrical.

In an exemplary embodiment, the shape of the double walled fabric material is formed to be rectangular.

In an exemplary embodiment, the shape of the double walled fabric material is formed to be square.

BRIEF DESCRIPTION OF THE DRAWINGS

These and/or other features and utilities of the present inventive concept will become apparent and more readily appreciated from the following description of the embodiments, taken in conjunction with the accompanying drawings of which.

Figure 1:
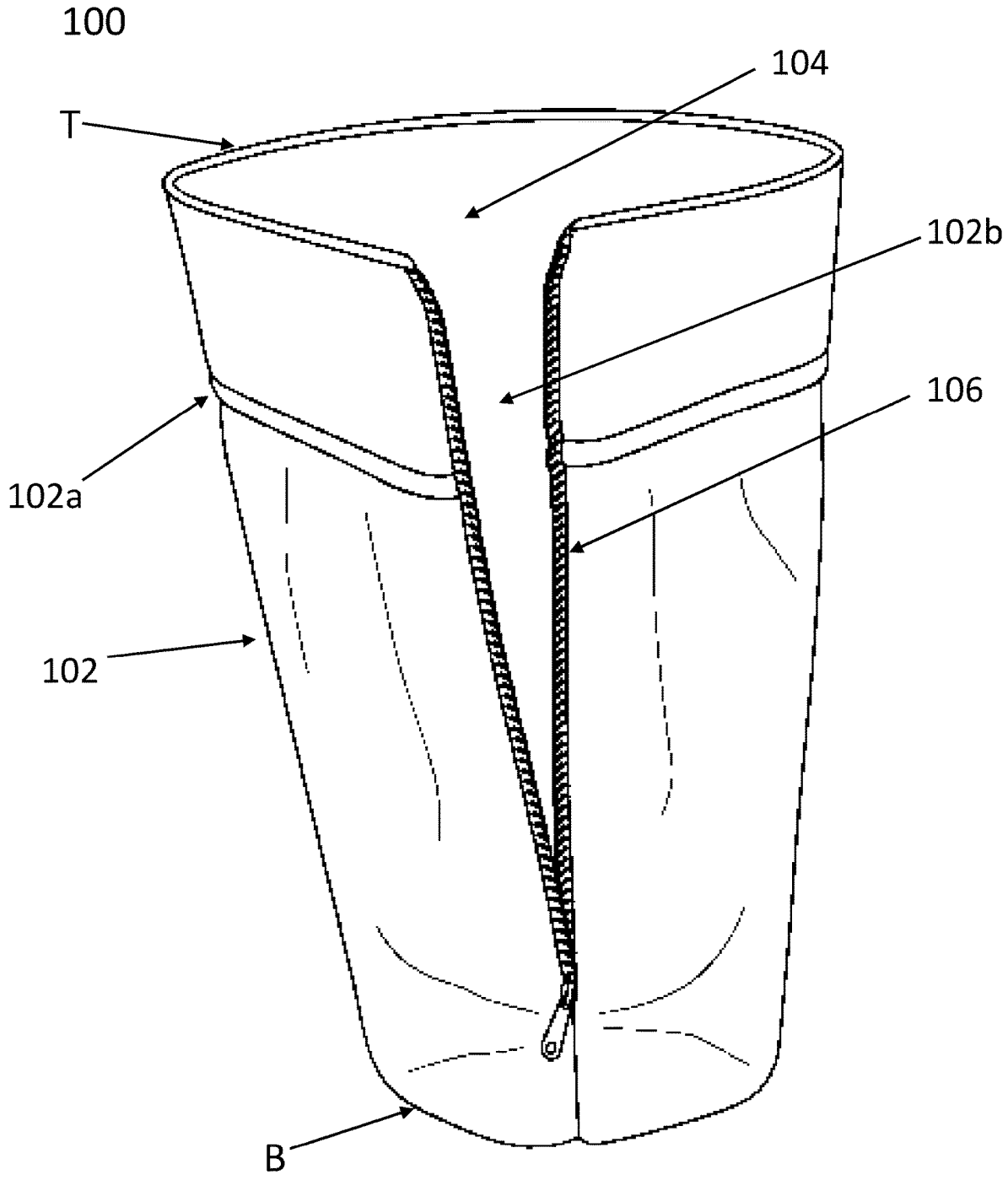
FIG. 1 illustrates a front perspective view of an openable napkin sleeve in an open configuration in accordance with an exemplary embodiment of the present inventive concept.

The drawings illustrate a few example embodiments of the present inventive concept, and are not to be considered limiting in its scope, as the overall inventive concept may admit to other equally effective embodiments. The elements and features shown in the drawings are to scale and attempt to clearly illustrate the principles of exemplary embodiments of the present inventive concept. In the drawings, reference numerals designate like or corresponding, but not necessarily identical, elements throughout the several views.

DETAILED DESCRIPTION OF THE PREFERRED EMBODIMENTS

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures. Also, while describing the present general inventive concept, detailed descriptions about related well-known functions or configurations that may diminish the clarity of the points of the present general inventive concept are omitted.

It will be understood that although the terms "first" and "second" are used herein to describe various elements, these elements should not be limited by these terms. These terms are only used to distinguish one element from another element. Thus, a first element could be termed a second element, and similarly, a second element may be termed a first element without departing from the teachings of this disclosure.

Expressions such as "at least one of," when preceding a list of elements, modify the entire list of elements and do not modify the individual elements of the list.

All terms including descriptive or technical terms which are used herein should be construed as having meanings that are obvious to one of ordinary skill in the art. However, the terms may have different meanings according to an intention of one of ordinary skill in the art, case precedents, or the appearance of new technologies. Also, some terms may be arbitrarily selected by the applicant, and in this case, the meaning of the selected terms will be described in detail in the detailed description of the invention. Thus, the terms used herein have to be defined based on the meaning of the terms together with the description throughout the specification.

Also, when a part "includes" or "comprises" an element, unless there is a particular description contrary thereto, the part can further include other elements, not excluding the other elements.

Hereinafter, one or more exemplary embodiments of the present general inventive concept will be described in detail with reference to accompanying drawings.

Example embodiments of the present general inventive concept are directed to a fabric napkin sleeve 100 configured to open and close to receive and secure a cloth napkin therein, and more particularly, but not exclusively, this inventive concept is directed to a fabric napkin sleeve configured to be openable and closable to receive and secure a cloth napkin and utensils therein.

In an exemplary embodiment, the fabric napkin sleeve 100 can be formed into a hollow cylindrical enclosed shape having a length from a top T to a bottom B sufficiently long enough to retain a majority of a rolled-up cloth napkin therein while a remaining portion of the napkin extends outward past a top portion T of the fabric napkin sleeve 100. However, the fabric napkin sleeve 100 can be formed into other enclosed shapes, such as a square or rectangular shape without departing from the spirit and scope of the present inventive concept. Preferably the fabric napkin sleeve 100 has a length of approximately 8.5 inches from the top portion T to a bottom portion B thereof. However, this preferred length of 8.5 inches is configured to receive therein a fabric napkin having both a length and a width of approximately 20 inches. The 8.5 inch length of the fabric napkin sleeve 100 is configured such that prior to inserting a 20 square inch napkin into the fabric napkin sleeve the 20 square inch napkin can be folded once horizontally and once vertically, thus resulting in a folded height and width napkin of approximately 10 inches. Then the folded napkin can be rolled-up to have a cylindrical shape with a length still being approximately 10 inches. The folded and rolled-up napkin having a length of approximately 10 inches can then be inserted into the fabric napkin sleeve 100 such that one end of the napkin will extend to the bottom B of the fabric napkin sleeve 100 while the opposite end of the napkin will extend outward from the top portion T thereof by approximately 1.5 inches. However, the length of the fabric napkin sleeve 100 can be configured to have different lengths based on the dimensions of a napkin intended to be inserted therein such that approximately 1.5 inches of the folded and rolled up napkin will extend outward from the top T of the fabric napkin sleeve 100 when placed therein such that one end of the napkin is aligned with the bottom portion B of the fabric napkin sleeve 100. In other words, for aesthetic purposes, the length of the fabric napkin sleeve 100 will be configured based on the size of the napkin to be placed therein such that an inserted napkin (folded up and rolled into a cylindrical shape) will extend past the top portion T of the fabric napkin sleeve 100 by approximately 1.5 inches while being aligned with and not extending past the bottom portion B of the fabric napkin sleeve 100.

As an alternative example, the fabric napkin sleeve 100 can be configured to have a length from the top portion T to the bottom portion B thereof to be approximately 7.5 inches when intending to receive therein a napkin having dimensions of approximately 18 square inches. By folding the 18 square inch napkin over horizontally and vertically the napkin will be 9 inches in width and 9 inches in height, thus extending approximately 1.5 inches above the top portion T of the fabric napkin sleeve 100 when rolled up and inserted therein.

The fabric napkin sleeve 100 as illustrated in FIG. 1 can include an outer fabric 102 and an inner fabric 104, wherein the outer fabric 102 and the inner fabric 104 can be sewn together along four sides thereof to overlap each other. Further, the fabric napkin sleeve 100 can be formed into a cylindrical shape and sewn together at two opposing ends thereof along approximately 14 of the length of the cylindrical sleeve 100 from the bottom portion B such that the fabric napkin sleeve 100 includes a slit 102*b* starting at the top T thereof and extending preferably ¾ the length toward the bottom B thereof. With this configuration the slit 102*b* starts approximately 14 the way up the length of the fabric napkin sleeve 100 from the bottom portion B and extends through the top portion T of the fabric napkin sleeve 100. Accordingly, the fabric napkin sleeve 100 will remain cylindrical in shape (or square or rectangular) with a slit extending along approximately ¾ of the length thereof as illustrated in FIG. 1.

The outer fabric 102 and the inner fabric 104 is preferably formed of a cloth material, such as cotton, or any other quality material which will provide flexibility, sustainability and can be washed and reused. For example, the fabric may be formed of a leather material, a wool material, or a silk material, etc., but is not limited thereto, and can be any material which can be cleaned and is sustainable. The fabric may also be formed of a material which is resistant to wine stains.

Along the length of the slit 102*b* is disposed an opening and closing means 106 to open and close the slit 102*b* as desired. The opening and closing means 106 is preferably a zipper 106 for ease in zipping open and closed the slit 102*b* and will be referred to herein as a zipper 106. However, alternative equivalent means for opening and closing the slit 102*b* can be provided which will perform the intended purposes of easily opening and closing the slit 102*b* as desired. For example, the opening and closing means 106 can be formed of a corresponding pair of hook and loop strips, such as Velcro©, or at least one button and corresponding button hole to button closed the slit 102*b* along the length thereof. The opening and closing means 106 can also be formed of a corresponding pair of flexible magnetic strips attached along opposite edges of the slit 102*b*.

The zipper 106 provides the following advantages. When it is intended to insert a rolled napkin 10 (see FIG. 4) into the fabric napkin sleeve 100, the slit 102*b* of the fabric napkin sleeve 100 can be exposed by operating the zipper 106 to open the slit 102*b* and expose the inner fabric 104. Then the napkin 10 can be easily placed inside the fabric napkin sleeve 100 by inserting the napkin 10 through the opening 102*b* such that one end of the napkin 10 is aligned with the bottom portion B of the fabric napkin sleeve 100 and an opposite end of the napkin 10 extends past the top portion T of the fabric napkin sleeve 100. Then the zipper 106 can be zipped closed to retain the napkin 10 within the fabric napkin sleeve 100, as illustrated in FIG. 4.

Figure 2:
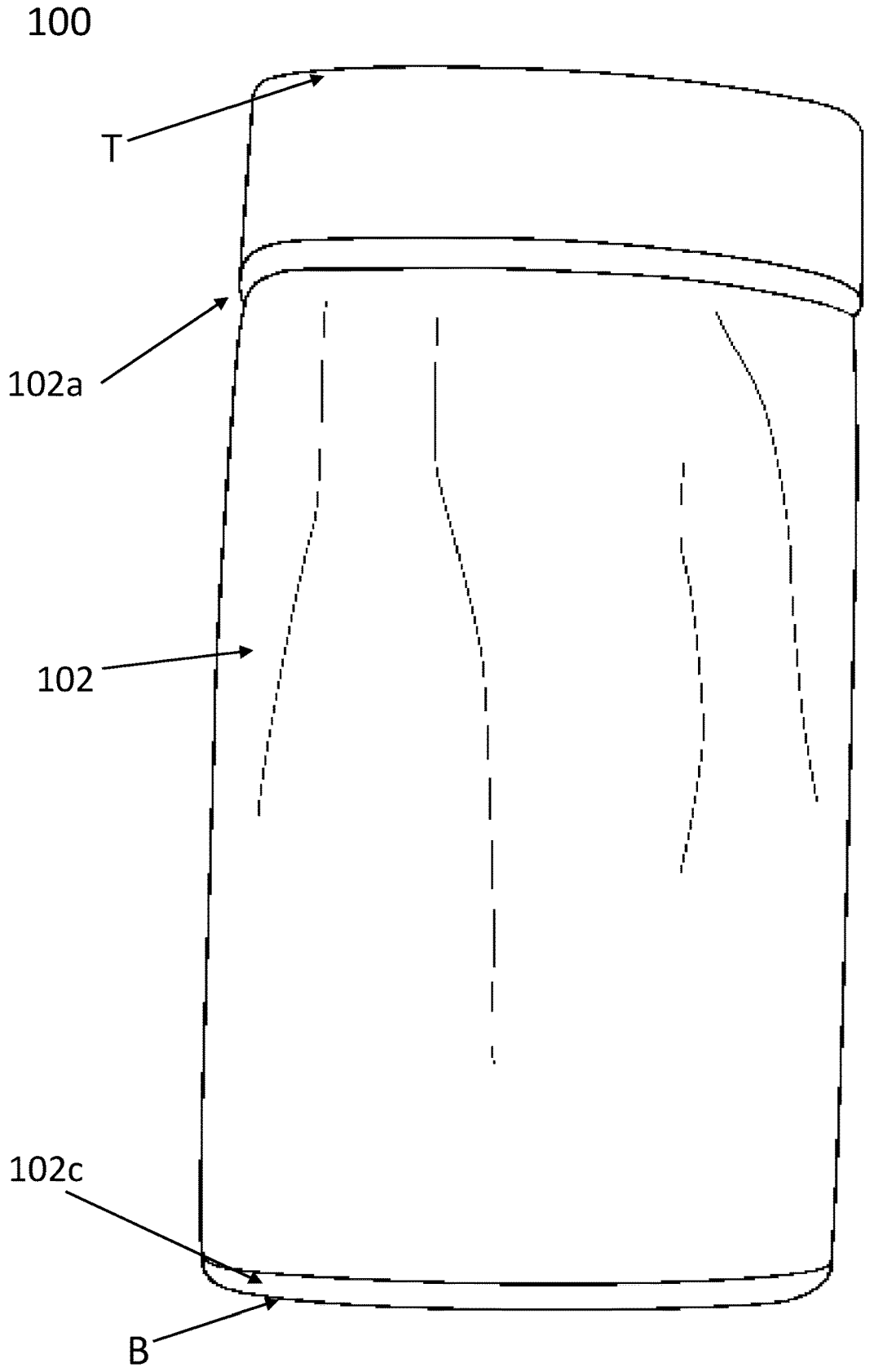
FIG. 2 illustrates a rear perspective view of the openable napkin sleeve in accordance with the exemplary embodiment of FIG. 1.

FIG. 2 illustrates a rear portion of the fabric napkin sleeve 100 opposite the front portion in which the zipper 106 is disposed. Also illustrated are the thick fabric rings 102*a* and 102*c* circling the fabric napkin sleeve 100.

Figure 3:
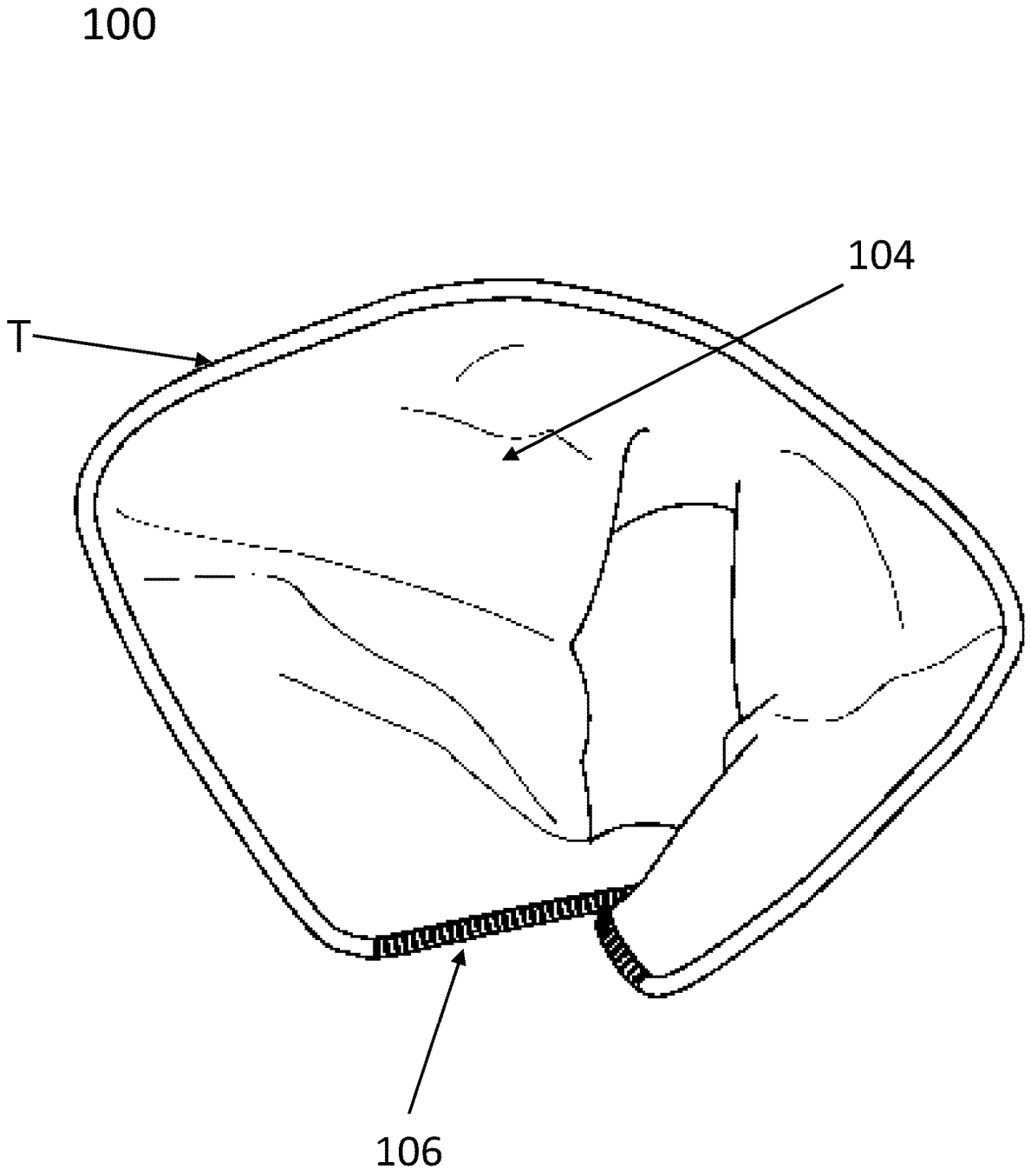
FIG. 3 illustrates a top view of the openable napkin sleeve in accordance with the exemplary embodiment of FIG. 1.

FIG. 3 illustrates a top view of the fabric napkin sleeve 100 looking down through the sleeve 100. Also illustrated is the inner fabric 104 and the zipper 106 disposed in an open position to expose the slit 102*b* and the inner fabric 104 so that a napkin 10 can be easily placed therein.

Figure 4:
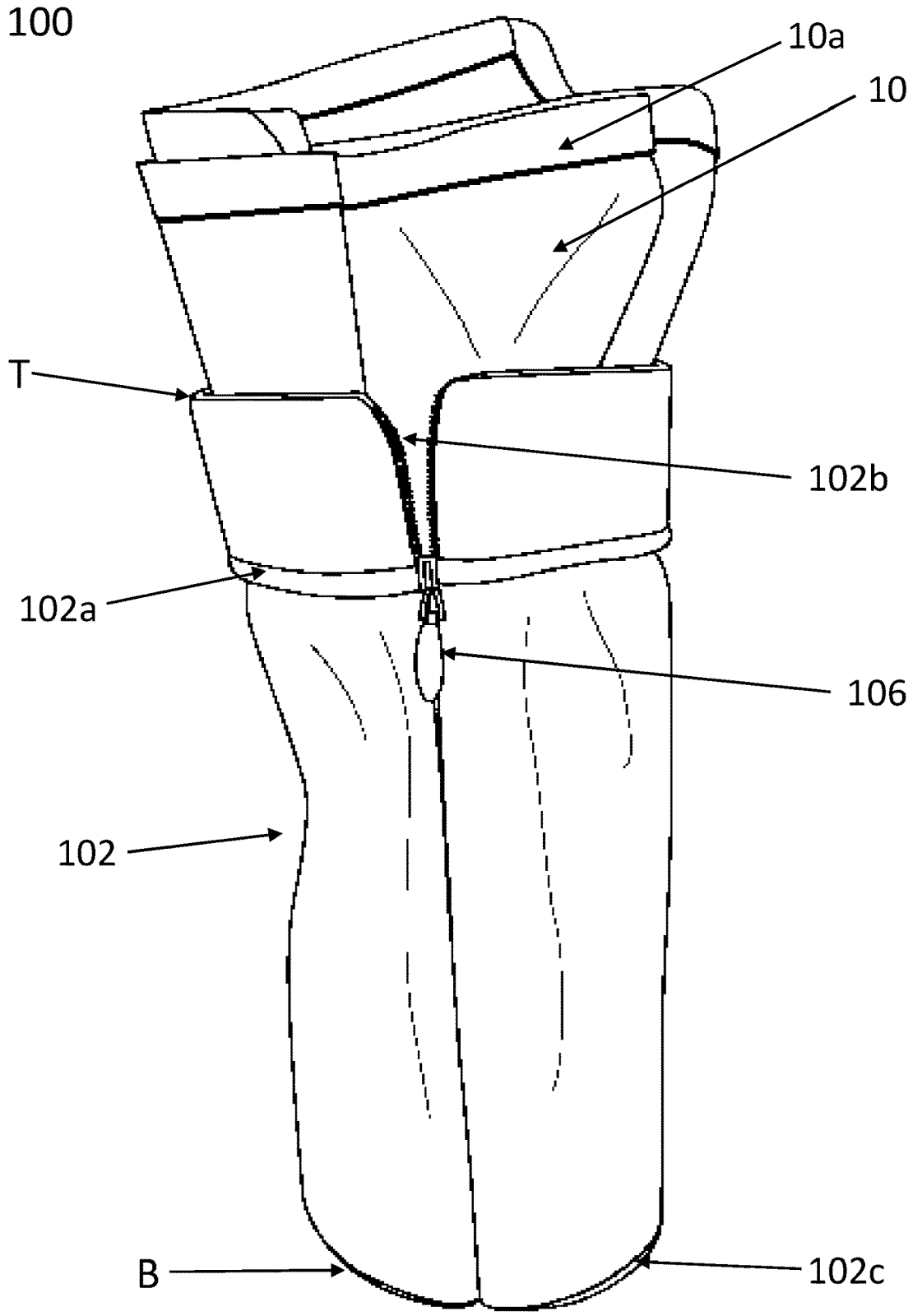
FIG. 4 illustrates another front perspective view of the openable napkin sleeve in accordance with the exemplary embodiment of FIG. 1 in a closed configuration.

Referring to FIGS. 2 and 4, the fabric napkin sleeve 100 can also include an upper fabric ring 102*a* and a lower fabric ring 102*c* which are thicker in material than the outer fabric 102. The upper fabric ring 102*a* is preferably disposed approximately 1 inch from the top portion T of the fabric napkin sleeve 100 and the lower fabric ring 102*c* is disposed around the circumference of the bottom of the fabric napkin sleeve 100. The thick fabric rings 102*a* and 102*c* provide at least two advantages as follows. The first advantage of the thick fabric rings 102*a* and 102*c* is to provide an aesthetic appearance in that the fabric rings 102*a* and 102*c* are provided in a different color than the outer fabric 102 so as to stand out from the outer fabric 102, while being of the same color as a color of a boarder 10*a* of the napkin 10. Thus, the thick fabric rings 102*a* and 102*c* match the color of the boarder 10*a* of the napkin 10. The second advantage of the thick fabric rings 102*a* and 102*c* is to provide additional support to the cylindrical fabric napkin sleeve 100 to help keep the shape of the cylindrical fabric napkin sleeve 100. Additionally, the lower fabric ring 102*c* prevents the bottom portion B of the fabric napkin sleeve 100 from fraying due to wear.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A flexible napkin sleeve, comprising:

a hollow enclosed elongated fabric material including an outer fabric and an inner fabric, the outer and inner fabrics being sewn together along four corresponding sides thereof to form a double thick fabric material, the hollow enclosed elongated fabric material having a slit formed lengthwise and originating at a top portion thereof and extending toward a bottom portion thereof such that the slit extends approximately ¾ the length of the hollow enclosed elongated fabric material; and an opening and closing means attached along opposite edges of the slit and being configured to open and close the slit.

2. The flexible napkin sleeve according to claim 1, wherein the opening and closing means is a zipper.

3. The flexible napkin sleeve according to claim 1, further comprising:

an upper fabric ring formed circumferentially around an upper portion of the hollow enclosed elongated fabric material approximately one inch from the top portion thereof, and a lower fabric ring formed circumferentially around the bottom portion of the hollow enclosed elongated fabric material.

4. The flexible napkin sleeve according to claim 1, wherein the fabric is made of any one of cotton, silk, wool or leather.

5. The flexible napkin sleeve according to claim 1, wherein the shape of the hollow enclosed elongated fabric material is cylindrical.

6. The flexible napkin sleeve according to claim 1, wherein the shape of the hollow enclosed elongated fabric material is rectangular or square.

7. A cylindrical napkin sleeve formed of a fabric material, comprising:

a slit starting at a top portion of the sleeve and extending along ¾ of a length thereof toward a bottom portion of the sleeve; and a zipper disposed along the slit to open the slit to insert a napkin therein and to close the slit to retain the inserted napkin therein.

8. The cylindrical napkin sleeve according to claim 7, further comprising:

a first fabric ring formed circumferentially around the sleeve adjacent to the top portion thereof, and a second fabric ring formed circumferentially around the sleeve along the bottom portion thereof.

9. The cylindrical napkin sleeve according to claim 7, wherein the fabric material includes an outer fabric material and an inner fabric material, wherein the outer fabric material and the inner fabric material are sewn together to form a double wall fabric material.

10. The cylindrical napkin sleeve according to claim 7, wherein the fabric material is one of either cotton, silk, wool or leather.

11. A method of making a flexible napkin sleeve, comprising:

sewing edges of a first fabric material to edges of a second fabric material to form a single double walled fabric material having a width and a length;

sewing a portion of opposite sides of the double walled cloth material to form a hollow enclosed elongated fabric having a slit along the length thereof which extends from a top portion thereof to approximately ¾ the length of the hollow enclosed elongated fabric and terminates at the sewn opposite sides; and attaching an opening and closing means along the edges of the slit to open and close the slit.

12. The method according to claim 11, wherein the shape of the hollow enclosed elongated fabric is formed to be cylindrical.

13. The method according to claim 11, wherein the shape of the hollow enclosed elongated fabric is formed to be rectangular.

14. The method according to claim 11, wherein the shape of the hollow enclosed elongated fabric is formed to be square.

* * * * *